US008021122B2

(12) United States Patent
Clayton et al.

(10) Patent No.: US 8,021,122 B2
(45) Date of Patent: Sep. 20, 2011

(54) INFLATION CONTROL APPARATUS FOR AN INFLATABLE OBJECT WITH TWO CHAMBERS

(75) Inventors: William R. Clayton, Madison, AL (US); Paul A. Gierow, Madison, AL (US)

(73) Assignee: GATR Technologies, Huntsville, AL (US)

( * ) Notice: Subject to any disclaimer, the term of this patent is extended or adjusted under 35 U.S.C. 154(b) by 717 days.

(21) Appl. No.: 12/178,724

(22) Filed: Jul. 24, 2008

(65) Prior Publication Data

US 2010/0018595 A1 Jan. 28, 2010

(51) Int. Cl.
*F04B 41/06* (2006.01)

(52) U.S. Cl. ..... 417/2; 417/17; 417/18; 417/426; 343/915

(58) Field of Classification Search ..... 137/87.05, 137/487.5; 417/2, 17, 18, 44.2, 426; 343/915
See application file for complete search history.

(56) References Cited

U.S. PATENT DOCUMENTS 2,814,038 A * 11/1957 Miller ..... 343/757
3,068,796 A * 12/1962 Pfluger et al. ..... 137/8
3,147,478 A * 9/1964 Bird ..... 343/765
3,653,264 A 4/1972 Mills
3,957,228 A 5/1976 Kennedy, Jr.
4,439,997 A * 4/1984 Cantley ..... 62/175
4,770,609 A * 9/1988 Uchida et al. ..... 417/2
5,465,772 A * 11/1995 Sartor ..... 152/416
6,045,331 A * 4/2000 Gehm et al. ..... 417/2
6,112,165 A 8/2000 Uhl et al.
6,115,003 A * 9/2000 Kozakoff ..... 343/840
6,142,740 A * 11/2000 Connell ..... 417/2
6,354,535 B1 * 3/2002 Perry et al. ..... 244/24
6,394,120 B1 * 5/2002 Wichert ..... 137/2
6,512,496 B2 * 1/2003 Alexeff et al. ..... 343/915
6,589,267 B1 * 7/2003 Hui ..... 606/202
6,963,315 B2 * 11/2005 Gierow et al. ..... 343/872
7,224,322 B1 * 5/2007 Ghaleb et al. ..... 343/915
2002/0134884 A1 * 9/2002 Perry et al. ..... 244/24
2006/0110258 A1 * 5/2006 Iimura et al. ..... 417/18
2008/0042921 A1 2/2008 Gierow et al.

* cited by examiner

*Primary Examiner* — John Rivell
*Assistant Examiner* — Matthew W Jellett
(74) *Attorney, Agent, or Firm* — George P. Kobler; Lanier Ford Shaver & Payne, P.C.

(57) ABSTRACT

Apparatus for maintaining differential internal fluid pressure in a dual fluid chamber object where it is desired for one chamber to have greater internal pressure than the other includes a sensor for generating a differential signal indicating the difference in pressure between the chambers, a pressure sensor for generating a pressure signal indicating the pressure inside the chamber desired to have less pressure, a comparator for generating a first output when the differential signal is less than a predetermined minimum differential value, a second comparator for generating a second output when the pressure signal is less than a predetermined minimum pressure value, where the predetermined minimum pressure value biased by the first output, and blowers coupled to the respective chambers and responsive to said first and second outputs respectively.

4 Claims, 4 Drawing Sheets

INFLATION CONTROL APPARATUS FOR AN INFLATABLE OBJECT WITH TWO CHAMBERS

BRIEF DESCRIPTION OF THE DRAWINGS

The present invention is described with reference to the accompanying drawings. In the drawings, like reference numbers indicate identical or functionally similar elements.

DETAILED DESCRIPTION

The various embodiments of the present invention and their advantages are best understood by referring to FIGS. 1 through 4. The drawings represent and illustrate examples of embodiments of the invention, and not limitations thereof. It will be apparent to those skilled in the art that various modifications and variations can be made in the present invention without departing from the scope and spirit of the invention as described herein. For instance, features illustrated or described as part of one embodiment can be included in another embodiment to yield a still further embodiment. Moreover, variations in selection of materials, or components and/or characteristics may be practiced to satisfy particular desired user criteria. Thus, it is intended that the present invention covers such modifications as come within the scope of the features and their equivalents.

Furthermore, reference in the specification to "an embodiment," "one embodiment," "various embodiments," or any variant thereof means that a particular feature or aspect of the invention described in conjunction with the particular embodiment is included in one or more embodiments of the present invention. Thus, the appearance of the phrases "in one embodiment," "in another embodiment," or variations thereof in various places throughout the specification does not necessarily limit the implementation of a described feature to a particular embodiment.

The inflation control apparatus described herein is generally contemplated for use with a dual chamber, inflatable, portable antenna apparatus. For an example of such inflatable antenna apparatuses, please see U.S. Pat. No. 6,963,315, to Gierow, et al, which is incorporated herein by reference. An inflatable antenna apparatus as contemplated herein is essentially a two-chamber, gas-filled sphere where a partition between the two chambers is maintained in the shape of a parabolic dish, or lenticular. The partition reflects energy to or from a feed (e.g., a horn) assembly mounted in, or near, the surface of the sphere. The parabolic shape of the reflector may be maintained by having higher air pressure in the chamber on the reflecting side of the partition, than in the chamber on the opposing side. There may be some communication of the fluid between chambers through one or more small apertures in the partition. It will be apparent to those skilled in the relevant arts with the benefit of this disclosure that the apparatus described below may be useful for any application in which it is desired for pressures in two adjacent chambers to be maintained at a differential.

Figure 1:
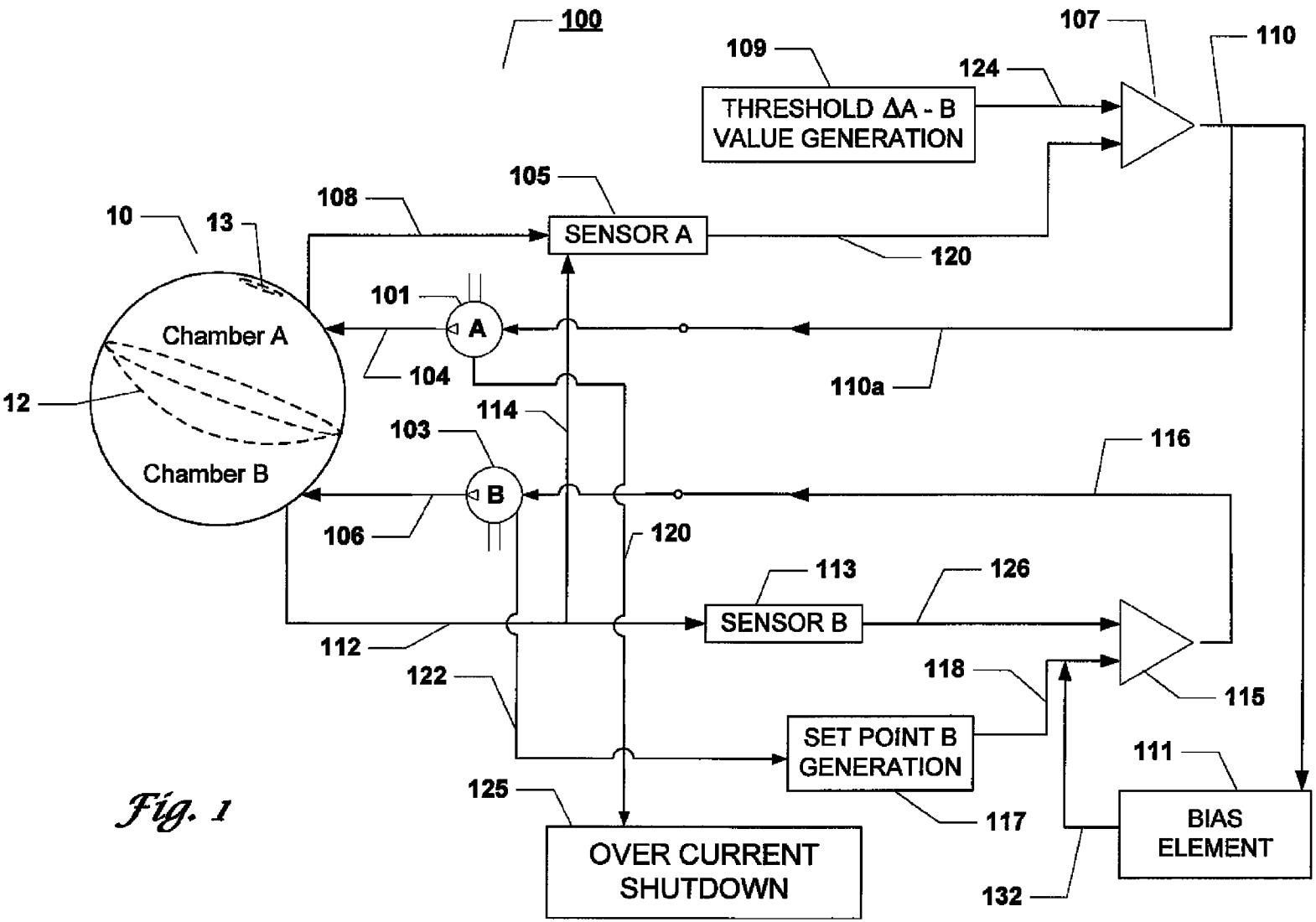
FIG. 1 is a functional schematic of an exemplary inflation control apparatus.

An exemplary inflation control apparatus for a dual-chamber inflatable object is shown in functional schematic in FIG. 1. Controller, identified generally at 100, is depicted, for illustrative purposes, as coupled to a spherical inflatable object 10, that has two chambers, Chamber A and Chamber B, that are separated by membrane 12, and a feed horn 13. In this exemplary scenario, in order to maintain the membrane in the proper shape to perform as a parabolic reflector, Chamber A must be maintained at a slightly higher pressure than Chamber B.

Blower A 101 is coupled to Chamber A and provides a fluid through conduit 104 to inflate and impart fluid pressure inside Chamber A. Blower B103 is coupled to Chamber B and provides fluid through conduit 106 to inflate and impart fluid pressure inside Chamber B.

A first pressure sensing line 108 is coupled at one end to Chamber A and at the other end to differential pressure sensor 105. Output of differential pressure sensor 105 is coupled as input to first comparator 107. First comparator 107 also includes a second input from first value generator 109 which permits a user to define desired value of the difference between the pressure in Chamber A and the pressure in Chamber B. First comparator 107 provides an output signal 110 to blower A 101 (designated 110*a*) and as input to bias element 111.

A second pressure sensing line 112 is coupled at one end to Chamber B and at the other end to pressure sensor 113. Second pressure sensing line is also coupled to differential pressure sensor 105 through branch line 114. Output 126 of pressure sensor 113 is coupled as input to second comparator 115. Second comparator 115 also includes a second input 118 from second value generator 117. Second comparator 115 provides output signal 116 to blower B 103. Bias element 111 provides bias output signal 132 coupled to second input 118. Finally, blower 101 and blower 103 each generate an output signal 120, 122 respectively coupled to an over-current cut-off device 125.

In operation, pressure from Chamber A is measured through first pressure sensing line 108 and detected by first sensor 105. A pressure from Chamber B is measured through second pressure sensing line 112 and relayed to first sensor 105 through branch line 114. First sensor 105 is configured to detect the difference between pressure from Chamber A conveyed via first sensing line 108 and pressure from Chamber B conveyed through second sensing line 112 and branch line 114. First sensor 105 outputs a signal 120 that represents a detected pressure differential between Chamber A and Chamber B. Output 120 is coupled as input to first comparator 107. First value generator 109 also provides input to first comparator 107. First value generator 109 provides a value as a differential threshold input 124 that is a desired minimum threshold difference in pressure between A and B. This value is preset.

First comparator 107 compares the detected pressure differential of output 120 with differential threshold input 124 and generates an output 110 if the detected pressure differential is lower than the differential threshold value. Output 110 of the first comparator 107 is coupled to blower A 101 and to bias element 111. Blower A 101 is configured to be responsive to output signal 110*a* by energizing and impelling fluid into Chamber A. Bias element 111 outputs a bias value signal 132 which is coupled to second input 118.

At the same time, a pressure indication from Chamber B is conveyed to second sensor 113, the output of which 126 indicates the detected pressure in Chamber B. This output 126 is coupled to second comparator 115. Second value generator 117 provides a threshold input 118 to second comparator 115. Second comparator 115 compares detected pressure signal 126 with the threshold signal 118 and generates output 116 if the detected pressure signal 126 is determined to be less than the threshold input 118. Output signal 116 is coupled to blower 103 which responds thereto by energizing and impelling fluid into Chamber B through conduit 106.

Bias value signal 132 imparts a bias voltage value to threshold value signal 118 reducing the threshold value. Thus, second comparator 115 is biased against generating an output 116 and turning on blower B 103. In this manner, blower B 103 is prevented from impelling fluid into Chamber B when the differential between Chamber A and Chamber B is not great enough, and so blower A 101 is allowed to operate to pressurize Chamber A until the differential threshold value is met.

Both blowers 101, 103 include current outputs 120, 122 to over-current cutoff 125 which cuts off power to the apparatus in the event either blower 101, 103 outputs a signal of exceedingly high current. This prevents the blowers 101, 103 from energizing excessively and over-pressurizing the object, reducing the likelihood of damage in the event of a loss of signal from either sensor 105, 113.

Each blower 101, 103, is configured to be variably responsive to the respective comparator 107, 115, throughout respective blower power ranges. In other words, blowers may be partially energized, or fully energized in response to the voltage from a comparator. Comparators 107, 115, are preferably configured to provide a proportional band control response, if a threshold is not properly met, as the detected values near the threshold values. Accordingly, the comparators may be configured with a pass band function, known in the art, to provide feedback and reduce comparator output if detected values approach within some percentage of the threshold. For example, if the pressure in Chamber B represented by the voltage signal 126 from pressure sensor 113 does not meet the preset threshold by greater than some predetermined amount, e.g., 5%, the second comparator 115 is configured to be at full response, and blower 103 is fully energized. However, as pressure in Chamber B approaches the preset threshold, or is within a predetermined amount, e.g., about 5%, voltage from the comparator 115 is reduced and thus, the blower 103 power is reduced. A cut-off may also be configured with the comparator so that, for example, the pressure in Chamber B is thereafter greater than the threshold by some predetermined amount, e.g., about 5%, no voltage issues from the comparator and the blower 103 is de-energized.

Figure 2:
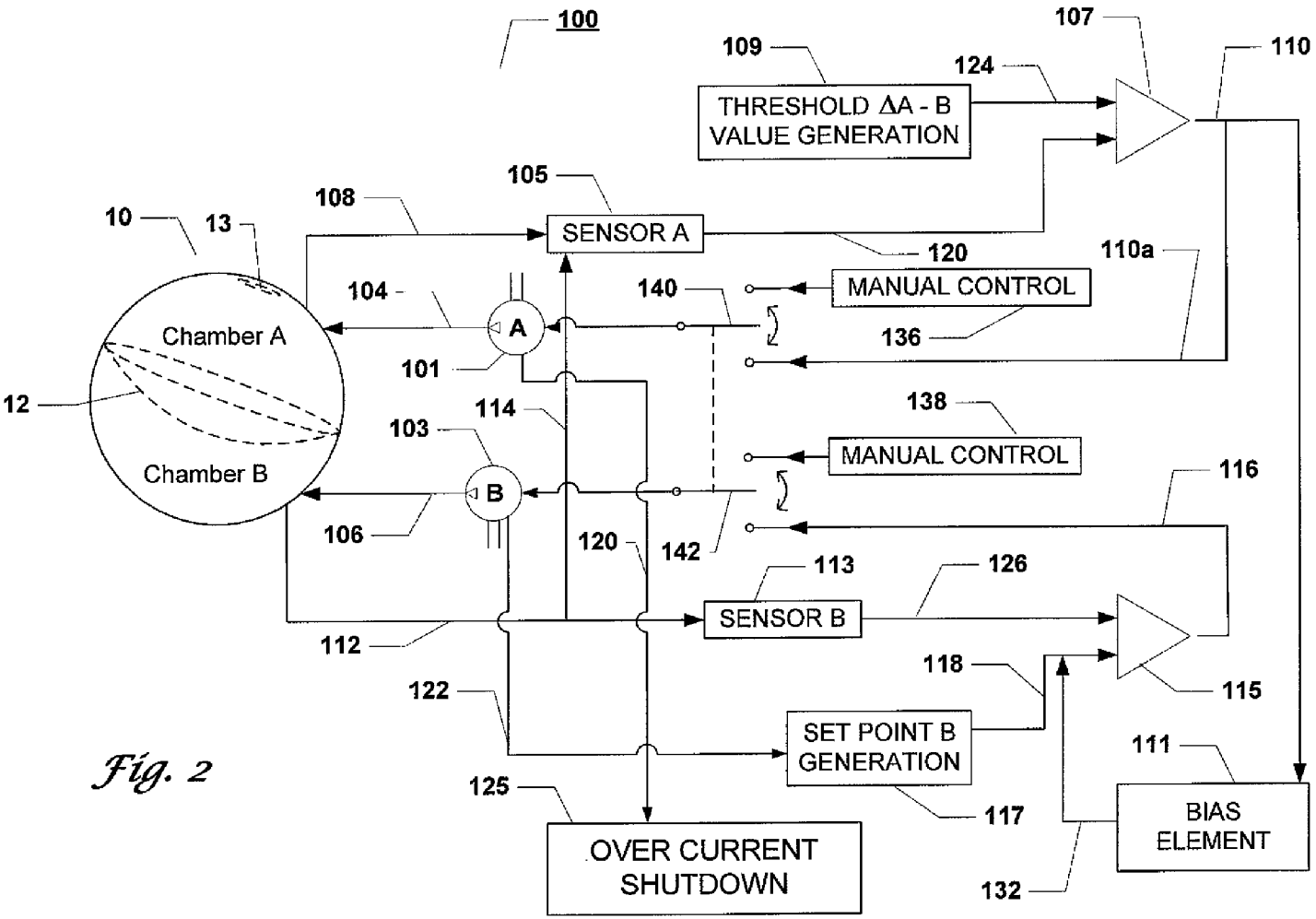
FIG. 2 is a functional schematic of another exemplary embodiment of the inflation control apparatus.

With reference to FIG. 2, an optional, alternative embodiment includes a first two-position switch 140 connected to blower A 101, and a second two-position 142 switch connected to blower B 103. A first manual control 136 is provided as an alternative contact in parallel with output 110*a* of first comparator 107. Similarly, a second manual control 138 is provided as an alternative contact in parallel with the output 116 of second comparator 115.

First and second manual controls 136, 138 are manual voltage generators, i.e., potentiometers. When the switches 140, 142 are thrown to contact first and second comparator outputs 110*a*, 116, respectively, operation of the apparatus is automatic, as described above. On the other hand, when the tied first and second switches 140, 142 are thrown to contact first and second manual control 136, 138 contacts, operation is manually controlled by a user providing value inputs or adjustments to first and/or second manual controls 136, 138. In addition, manual controls 136, 138, are preferably responsive to one or more displays (not shown) which allow the user to see the settings for possible thresholds. Displays could be analog, or digital.

Figure 3:
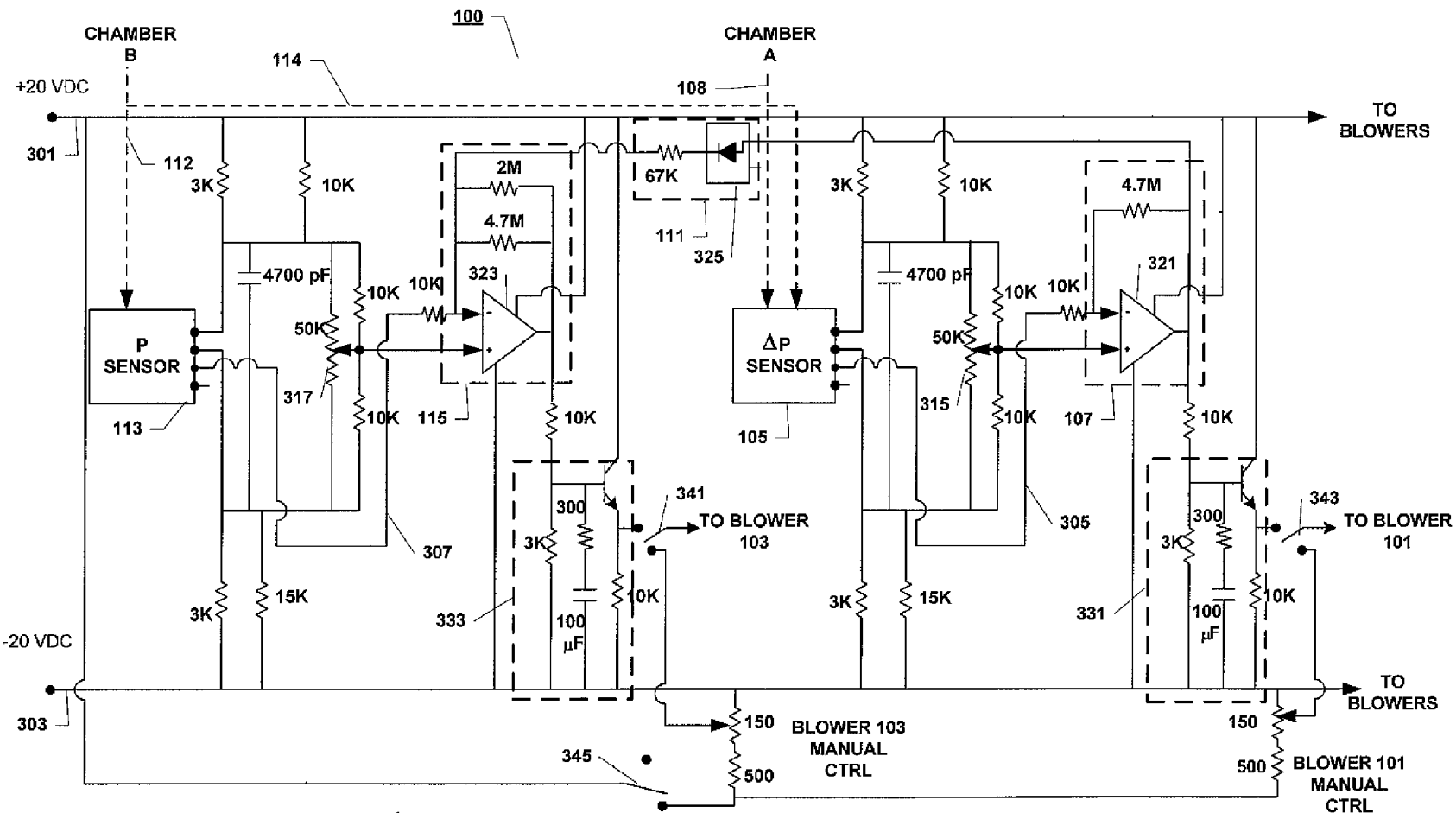
FIG. 3 is an exemplary circuit diagram of a controller.

FIG. 3 is an exemplary circuit diagram of the previously described embodiment of the controller identified generally at 100 provided to show how the functional elements described above may be achieved. It should be noted that circuit elements not otherwise identified in the specification are shown in the diagram and are believed to be understandable to one of ordinary skill in the art. Furthermore, the values shown as parameters are exemplary only. It is contemplated that different elements, and different parameters may be used to achieve the functions of the controller described in this specification.

Controller 100 includes a power supply line shown at 301, and a return line 303, where the latter also includes grounds. Tubes conveying pressure information to pressure sensors are indicated in dashed lines at 112, 114, 108. Tube 112 is connected to Chamber B (not shown) and conveys the pressure from Chamber B to pressure sensor 113. Tube 108 is connected to Chamber A (also not shown) and conveys pressure from Chamber A to differential pressure sensor 105. Tube 114 is a branch line from the tube 112 that also conveys pressure information from Chamber B to differential pressure sensor 105. Differential pressure sensor 105 is configured to receive and read pressure information from both tubes 108 and 114, and output via conductor 305 a voltage representative of the difference of the respective pressures. On the other hand, pressure sensor 113 is configured to receive and read the pressure information conveyed through tube 112 and output via conductor 307 a voltage representative of the pressure in Chamber B.

Conductor 305 is connected to first comparator 107 on the "minus" side thereof. First value generator 109 can be achieved with a potentiometer 315 which provides a threshold value input to the "plus" side of the comparator 107. The comparator 107 outputs a voltage representative of the differential if the differential does not meet or exceed the threshold value. Similarly, conductor 307 is connected to second comparator 115 on its "minus" side. Second value generator may also be achieved with potentiometer 317 which provides a threshold value input to the "plus" side of the second comparator 115. In turn, second comparator 115 outputs a voltage representative of the pressure if the pressure is below the threshold value provided by the potentiometer 317. Comparators 107, 115 can be achieved using an operational amplifier 321, 323, for example, a uA741 operational amplifier produced by Fairchild Semiconductor, with suitable external circuitry, which could be that shown in the exemplary circuit diagram of FIG. 3.

As described above, the output of the first comparator is also coupled to a bias element 111 the output of which is coupled to second comparator 115 through the threshold input. Bias element 111 may be achieved employing a switching diode 325, which may be, for example, a MMBD914 also by Fairchild Semiconductor.

The respective output of each comparator, when the threshold values are not met, or exceeded, as the case may be, are conducted to the blowers 101, 103 for each chamber. It may be beneficial to employ circuitry to compensate for phase shifting that could take place in the comparator circuitry prior to reaching the blowers 101, 103. Examples of such circuits are shown at 331, 333, and it is believed, would be understood by those skilled in the art. Finally, switches indicated at 341, 343, and 345 are operable to allow a switch from automatic to manual control, and may be achieved with well-known triple pole, double throw (TPDT) toggle switches.

Figure 4:
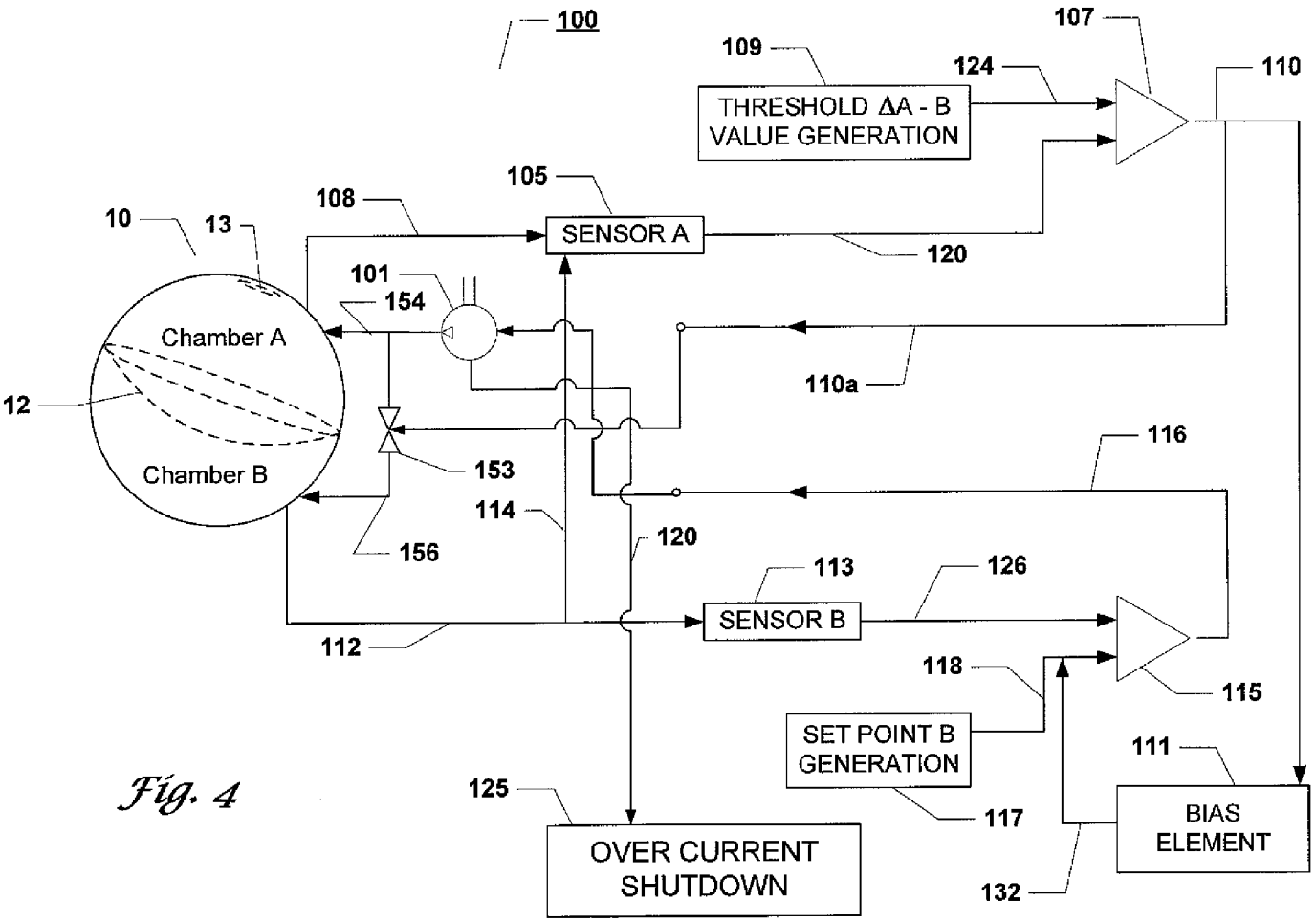
FIG. 4 is a functional schematic of a third exemplary embodiment of the inflation control apparatus.

FIG. 4 presents a further exemplary embodiment wherein only one blower 101 is employed. Second comparator output 116 is coupled to blower 101 while first comparator output 110*a* is coupled to a proportional valve 153, which may be, for example, a variable duty cycle solenoid valve. Blower 101 is configured impel fluid through two conduits: first conduit 154, which is coupled to provide fluid into Chamber A; and second conduit 156, which is coupled to provide fluid into Chamber B. Proportional valve 153 is interposed along second conduit 156 between blower 101 and Chamber B. In addition, blower 101 is configured to generate an overcurrent signal 120 that is received by over-current shutdown circuitry 125.

In operation, output from second comparator 116 is emitted when second sensor 113 detects a pressure below the desired minimum in Chamber B, biased by output from bias generator 132. Output 116 energizes blower 101 which impels fluid to both Chamber A and Chamber B through first and second conduits 154, 156. Proportional valve 153 is configured to close in response to output signal 110*a*. Therefore, when pressure differential is below the desired or required threshold, the valve is closed and Chamber A is pressurized until the proper pressure differential is achieved.

Proportional valve 153 is preferably proportionally responsive to the voltage from comparator 107 such that it may be partially closed to a degree in proportion to the voltage 110*a* received from comparator 107. Valve 153 may be achieved with a continuously proportional valve, or may be a variable duty cycle valve.

As described above and shown in the associated drawings, the present invention comprises dual chamber inflation control apparatus. While particular embodiments of the invention have been described, it will be understood, however, that the invention is not limited thereto, since modifications may be made by those skilled in the art, particularly in light of the foregoing teachings. It is, therefore, contemplated by the following claims to cover any such modifications that incorporate those features or those improvements that embody the spirit and scope of the present invention.

What is claimed is:

1. An apparatus for controlling the fluid pressure in a spherical object having first and second fluid-filled chambers in which it is desired for the first chamber to have a greater internal pressure than the second chamber, said apparatus comprising:

first pressure sensor configured to detect a difference in internal pressure between said first chamber and said second chamber and to output a differential value signal representing a difference in pressure between said first chamber and said second chamber;

second pressure sensor configured to detect internal pressure within said second chamber and to output a detected pressure signal representing the internal pressure within said second chamber;

a first threshold value generator for providing a first predetermined value signal indicating the desired difference in pressure between said first and second chambers;

a first comparator responsive to said first pressure sensor and said first threshold value generator, said first comparator configured to generate a first comparator output when said differential value signal is less than said first predetermined value signal;

a first blower responsive to said first comparator output for pressurizing said first chamber;

a second threshold value generator for providing a second predetermined value signal indicating the desired pressure within said second chamber;

a second comparator responsive to said detected pressure signal and said second predetermined value signal configured to generate a second comparator output when said detected pressure signal indicates a value less than a value indicated by said second predetermined value signal, wherein said second predetermined value signal is biased with input from said first comparator output; and a second blower responsive to said second comparator output for pressurizing said second chamber.

2. The apparatus of claim 1, wherein said first and second threshold value generators are configured to allow said first and second predetermined values to be manually set.

3. The apparatus of claim 1, further comprising third and fourth threshold value generators that are configured to allow said predetermined values to be manually set, and means for selecting either said first and second threshold value generators or said third and fourth value generators.

4. Apparatus for maintaining differential internal fluid pressure in an object having two fluid filled chambers in which it is desired for one chamber to have greater internal pressure than the other, said apparatus comprising:

a differential pressure sensor for generating a differential signal indicating the difference in pressure between said chambers;

a pressure sensor for generating a pressure signal indicating the pressure inside one of the chambers;

a first comparator for generating a first output when said differential signal is less than a predetermined minimum differential value;

a second comparator for generating a second output when said pressure signal is less than a predetermined minimum pressure value, said predetermined minimum pressure value biased by said first output;

first and second blowers responsive to said first and second outputs respectively for inflating said chambers.

* * * * *